US008179335B2

(12) United States Patent
Chereson

(10) Patent No.: US 8,179,335 B2
(45) Date of Patent: May 15, 2012

(54) STEPPED RADOME AND ANTENNA HAVING A STEPPED RADOME

(75) Inventor: Jeffrey D. Chereson, Erie, PA (US)

(73) Assignee: Spectrum Control, Inc., Fairview, PA (US)

( * ) Notice: Subject to any disclaimer, the term of this patent is extended or adjusted under 35 U.S.C. 154(b) by 382 days.

(21) Appl. No.: 12/398,046

(22) Filed: Mar. 4, 2009

(65) Prior Publication Data

US 2009/0224997 A1 Sep. 10, 2009

Related U.S. Application Data

(60) Provisional application No. 61/033,677, filed on Mar. 4, 2008.

(51) Int. Cl.
*H01Q 1/42* (2006.01)

(52) U.S. Cl. ..... 343/872; 343/700 MS

(58) Field of Classification Search ..... 343/872, 343/700 MS
See application file for complete search history.

(56) References Cited

U.S. PATENT DOCUMENTS

| | | | | |
|---|---|---|---|---|
| 2007/0103374 | A1* | 5/2007 | Lindackers et al. | 343/713 |
| 2008/0252552 | A1* | 10/2008 | Goebel et al. | 343/872 |
| 2009/0096687 | A1* | 4/2009 | Gentilman et al. | 343/705 |
| 2011/0056718 | A1* | 3/2011 | Gattus et al. | 174/2 |

FOREIGN PATENT DOCUMENTS

JP 2003-142917 * 5/2003

* cited by examiner

*Primary Examiner* — Hoanganh Le
(74) *Attorney, Agent, or Firm* — Hodgson Russ LLP

(57) ABSTRACT

The invention may be embodied as a radome having an exterior-facing surface. The exterior-facing surface has a step. The step facilitates the movement of water toward an outer edge of the radome. The radome may be incorporated into an antenna.

19 Claims, 5 Drawing Sheets

STEPPED RADOME AND ANTENNA HAVING A STEPPED RADOME

CROSS-REFERENCE TO RELATED APPLICATION

This application claims the benefit of priority to U.S. provisional patent application Ser. No. 61/033,677, filed on Mar. 4, 2008.

FIELD OF THE INVENTION

The present invention relates to devices for covering the radiator of an antenna. The present invention may be embodied as a radome.

BACKGROUND OF THE INVENTION

Single antenna elements, antenna arrays, and antenna systems utilize radomes to protect the antenna components (which may include an antenna and related circuitry). The radome shields the antenna components by preventing objects on one side of the radome from reaching the antenna components that are located on another side of the radome. For example, the antenna components may be protected by a radome from the vagaries of people and/or weather conditions.

Radomes designed for outdoor-use must be capable of shedding water from the surface of the radome, particularly when a major surface of the radome is oriented horizontal to the force of gravity. When water exists in the path of the signals emanating from or to the antenna, the signals may be attenuated. For example, when more than about 20% of the radiating area is covered by water, the attenuation can be significant. Signal attenuation makes incoming and outgoing signals difficult to detect and amplify. Furthermore, when water exists in the path of the signal, the center frequency of the antenna system may shift due to the different electromagnetic characteristics of air and water.

In the prior art, a radome having a curved surface is placed over the antenna in order prevent water from contacting the antenna and in order to prevent water from accumulating in the path of the signals traveling to and from the antenna. The curved surface of the prior art is usually spherical in shape—that is to say that many prior art radomes have an external surface that is a portion of a sphere.

The spherical surfaces of existing radomes allow water to run off the radome, but these radomes increase the size of the antenna assembly, thereby causing the antenna assembly to occupy space that could be used by other components, and/or causing the radome to extend further from a surface to which the antenna is mounted. In situations where the antenna components are mounted below the plane of an exterior surface (e.g. for aerodynamic or aesthetic reasons), a spherical radome designed to prevent water accumulation may extend beyond the exterior surface, thereby reducing the benefits of mounting the antenna components below the exterior surface.

Thus, there is a need for a radome that can prevent water from accumulating, while also minimizing the size of the antenna assembly.

SUMMARY OF THE INVENTION

The invention may be embodied as a radome having an exterior-facing surface. The exterior-facing surface has a step. The step may be positioned in the path of signals to be transmitted to a receiver by a radiator which is to be covered by the radome. For example, the step may intersect an imaginary line extending perpendicularly from the radiator. The step may form an edge in the shape of a square, triangle, circle, oval or other shape.

In one embodiment of the invention, the exterior-facing surface of the radome has a first substantially planar surface extending from a first side of the step, and a second substantially planar surface extending from a second side of the step.

To facilitate movement of water, a radome according to the invention may have additional features. For example, a water-repelling coating may be applied to the exterior-facing surface, and/or the exterior-facing surface may be polished.

The invention may be an antenna having such a radome. In such an antenna, a radiator is covered by the radome. The radiator may be substantially planar. In such an antenna, the radome provides a surface facing away from the radiator, and the step is part of the surface facing away from the radiator.

BRIEF DESCRIPTION OF THE DRAWINGS

For a fuller understanding of the nature and objects of the invention, reference should be made to the accompanying drawings and the subsequent description. Briefly, the drawings are.

FURTHER DESCRIPTION OF THE INVENTION

Figure 1:
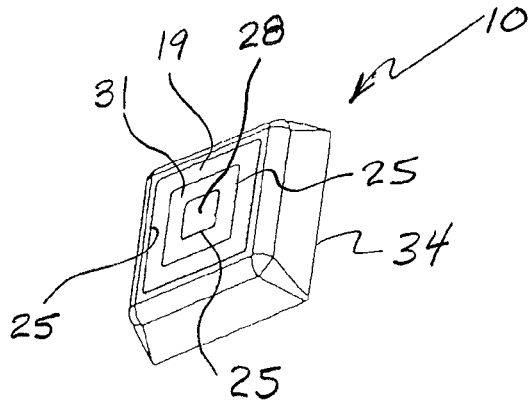
FIG. 1 is a perspective depiction of an exterior-facing surface of a radome according to the invention.
Figure 2:
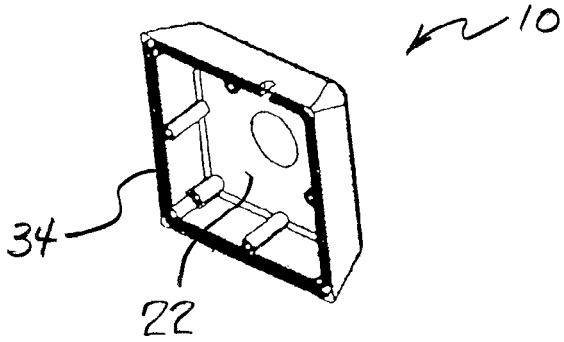
FIG. 2 is a perspective depiction of the radome from FIG. 1 showing the interior-facing surface of the radome shown in FIG. 1.
Figure 3:
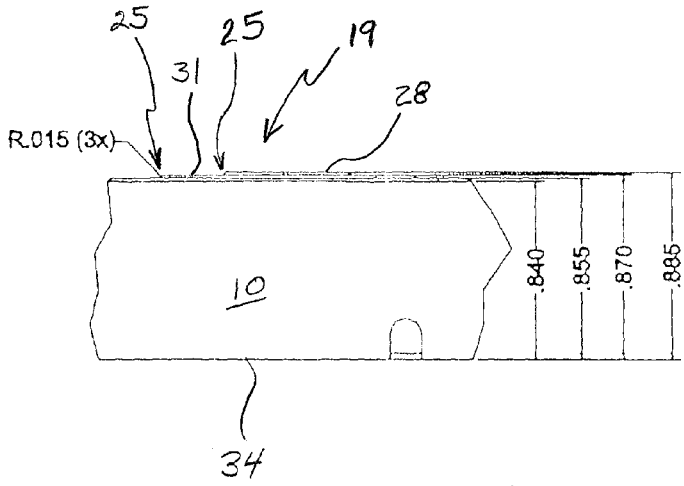
FIG. 3 is a side view of a portion of the radome depicted in FIG. 1 showing the steps in more detail.
Figure 4:
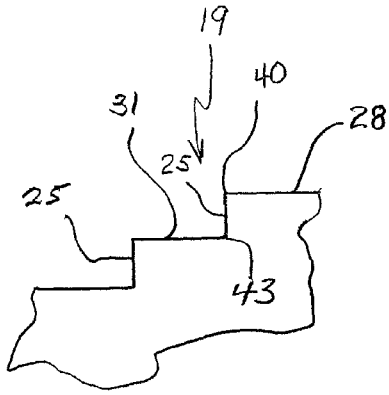
FIG. 4 is an enlarged side view of a portion of the steps depicted in FIG. 1 and FIG. 3.

FIG. 1 and FIG. 2 depict one embodiment of the invention. FIG. 1 shows a radome 10, which may be used to cover a radiator 13 of an antenna 16. The radome 10 has an exterior-facing surface 19 and an interior-facing surface 22. The radome 10 may be positioned so that the interior-facing surface 22 of the radome 10 faces the radiator 13, and so that the exterior-facing surface 19 faces away from the radiator 13. The exterior-facing surface 19 has a step 25. The stepped exterior-facing surface 19 allows water to flow from a first portion 28 of the exterior-facing surface 19, down the step 25 to a second portion 31 of the exterior-facing surface 19. In this manner, water is allowed to run off the exterior-facing surface 19 efficiently. In one embodiment of the invention, the exterior-facing surface 19 has a series of small steps 25, and such an embodiment may provide a suitable substitute for a spherical (domed) radome found in the prior art, but achieves a similar effect with regard to water run-off and without requiring as much space as a domed radome. FIG. 3 and FIG. 4 provide additional detail about the small steps 25 in one embodiment of the invention. The steps 25 of the exterior-facing surface 19 allow the surface tension of the water to be broken, thereby allowing water to flow from one side of the step 25 to another side of the step 25. The steps 25 may be arranged to cause water to move toward a perimeter 34 of the radome 10.

The step 25 of the exterior-facing surface 19 may be positioned such that signals emanating from the radiator 13 must pass through and/or near the step 25. In this manner, the step 25 is positioned so that water does not accumulate in an area that is needed for transmitting signals to a receiver 37. In one embodiment of the invention, the radiator 13 is substantially planar, and the step 25 is arranged above the radiator 13 so that the step 25 intersects an imaginary line (see FIG. 7) extending perpendicularly from the radiator 13. By placing the step 25 in or near the path of signals to be transmitted to a receiver 37 by a radiator 13, the radome 10 not only covers the radiator 13, but also prevents water from standing on the radome 10 and thereby interfering with transmission of signals.

The first portion 28 of the exterior-facing surface 19 may be substantially planar. The second portion 31 of the exterior-facing surface 19 may be substantially planar, albeit at a different elevation from the first portion 28 due to the step 25 that exists between the first portion 28 and the second portion 31. In this manner, the first portion 28 of the exterior-facing surface 19 extends from a first side 40 of the step 25, and the second portion 31 of the exterior-facing surface 19 extends from a second side 43 of the step 25. The first portion 28 of the exterior-facing surface 19 may be angled or shaped so that water is encouraged to flow toward the step 25, and the second portion 31 of the exterior-facing surface 19 may be angled or shaped so that water is encouraged to flow away from the step 25. FIG. 4 depicts the sides 40, 43 of the step 25 as forming a sharp angle with the first portion 28 of the exterior-facing surface 19, and a sharp angle with the second portion 31 of the exterior-facing surface 19, but the invention is not limited to such sharp sides 40, 43. For example, one of more of the sides 40, 43 of the step 25 (a.k.a. edges) may be rounded.

Figure 5:
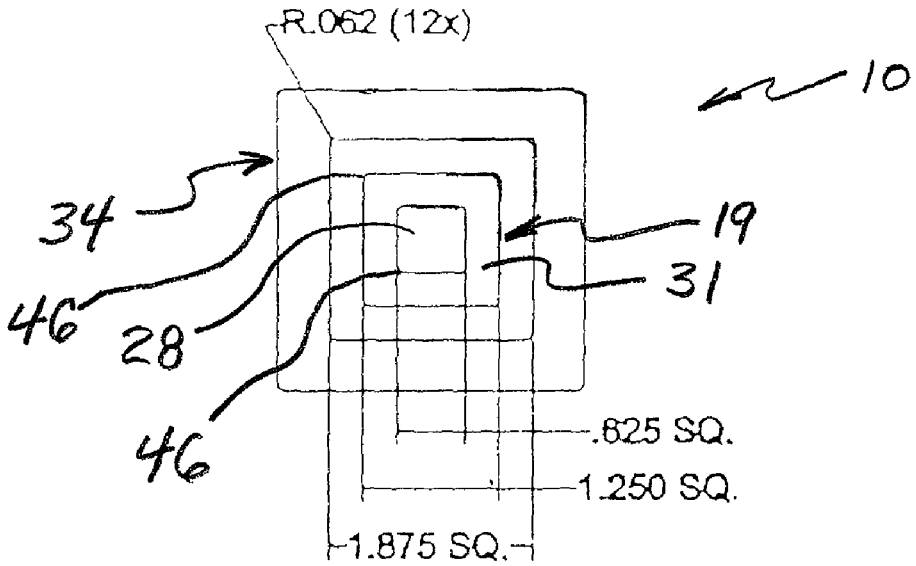
FIG. 5 is a plan view of the exterior-facing surface from FIG. 1.
Figure 6:
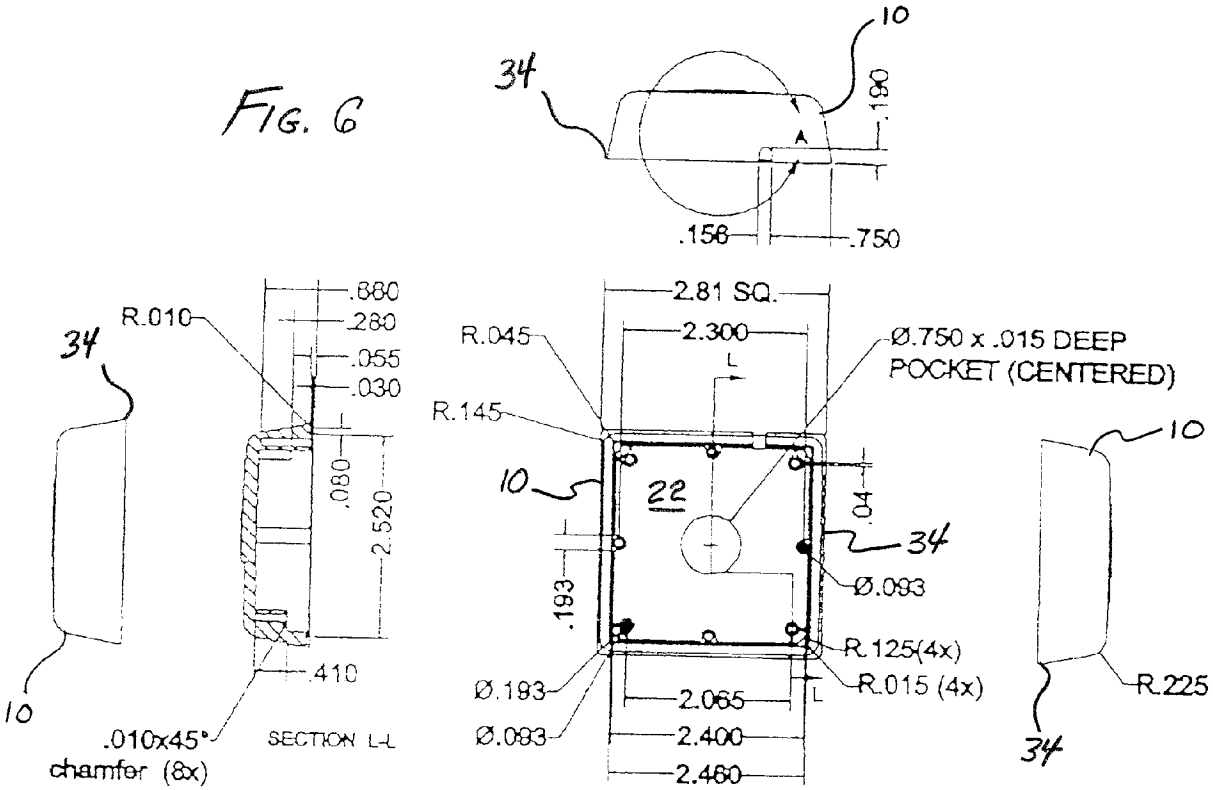
FIG. 6 is a bottom view, three side views and a cross-sectional view of the radome depicted in FIG. 1.

One or both sides 40, 43 of the step 25 may form a geometric shape, such as a rectangle, triangle, circle, oval. However, the geometric shape need not be one that is common. FIG. 1 and FIG. 5 depicts steps 25 which are substantially square, but with rounded corners 46. When the geometric shape is a closed-curve, the step 25 forms a perimeter of the first portion 28 of the exterior-facing surface 19.

The radome 10 may have a water-repelling coating applied to the exterior-facing surface 19. For example, wax or a polymer may be applied to the exterior-facing surface 19 so that water flows across the exterior-facing surface 19 easily. In lieu of coating the radome 10 with a water-repelling material, the radome 10 may be formed from a water-repelling material, and/or polished to provide a smooth surface.

Figure 7:
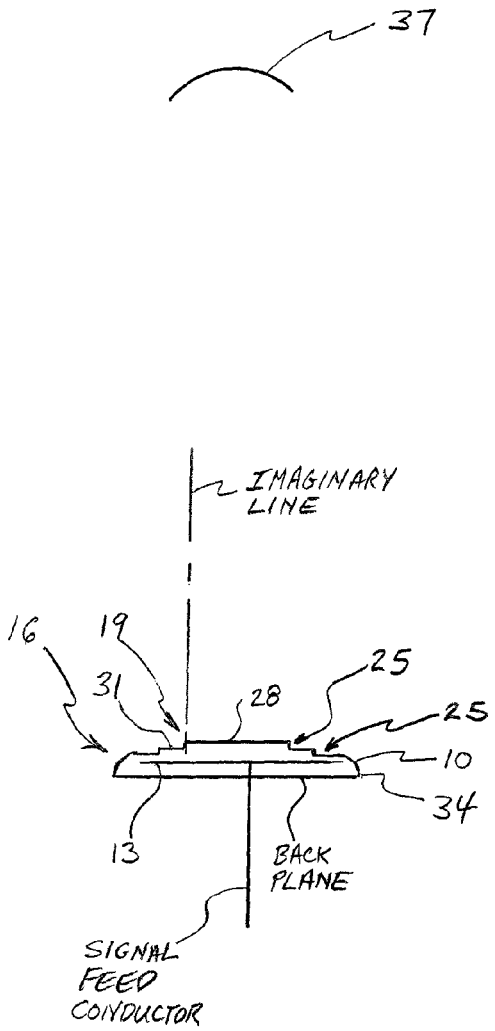
FIG. 7 is a schematic of an antenna according to the invention.

A radome 10 according to the invention may be made part of an antenna 16 which has a radiator 13. FIG. 7 depicts one such antenna 16. By placing the step 25 in the path of signals intended for reception by a receiver 37, the antenna 16 may be better able to transmit from the radiator 13 to the receiver 37, and in this manner may improve the ability of the receiver 37 and its corresponding circuitry to interpret and make use of the information transmitted by the radiator 13 and other components of the antenna 16.

The number and size of the steps 25 may be varied to accommodate different sizes of radomes 10. The number and size of the steps 25 may be selected to minimize the amount of water that is allowed to accumulate on any particular portion of the exterior-facing surface 19, while also taking into account the "footprint" (i.e. the size and shape of the perimeter 34) of the radome 10 and the maximum permitted distance between radiator 13 and the radome 10.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A radome having an exterior-facing surface having steps, each step having a perimeter dimension and a step dimension, wherein each step has a step ratio between 166:1 and 500:1, the step ratio being the perimeter dimension divided by the step dimension.

2. The radome of claim 1, wherein at least one step is in a path of signals to be transmitted to a receiver by a radiator which is to be covered by the radome.

3. The radome of claim 2, wherein at least one step intersects an imaginary line extending perpendicularly from the radiator.

4. The radome of claim 1, wherein at least one step has an edge in the shape of a square.

5. The radome of claim 1, wherein at least one step has an edge in the shape of a triangle.

6. The radome of claim 1, wherein at least one step has an edge in the shape of a circle.

7. The radome of claim 1, wherein at least one step has an edge in the shape of an oval.

8. The radome of claim 1 further comprising a water-repelling coating applied to the exterior-facing surface.

9. The radome of claim 1 wherein the exterior-facing surface is polished.

10. An antenna, comprising:

a radiator, and a radome having an exterior-facing surface having steps, each step having a perimeter dimension and a step dimension, wherein each step has a step ratio between 166:1 and 500:1, the step ratio being the perimeter dimension divided by the step dimension.

11. The antenna of claim 10, wherein at least one step is in a path of signals to be transmitted to a receiver by the radiator.

12. The antenna of claim 10, wherein the radiator is substantially planar.

13. The antenna of claim 12, wherein at least one step intersects an imaginary line extending perpendicularly from the radiator.

14. The antenna of claim 10, wherein at least one step has an edge in the shape of a square.

15. The antenna of claim 10, wherein at least one step has an edge in the shape of a triangle.

16. The antenna of claim 10, wherein at least one step has an edge in the shape of a circle.

17. The antenna of claim 10, wherein at least one step has an edge in the shape of an oval.

18. The antenna of claim 10 further comprising a water-repelling coating applied to the exterior-facing surface.

19. The antenna of claim 10 wherein the exterior-facing surface is polished.

* * * * *